US009488942B2

(12) United States Patent
Ishimori

(10) Patent No.: US 9,488,942 B2
(45) Date of Patent: Nov. 8, 2016

(54) BELT UNIT AND IMAGE FORMATION APPARATUS

(71) Applicant: Oki Data Corporation, Tokyo (JP)

(72) Inventor: Keita Ishimori, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/945,663

(22) Filed: Nov. 19, 2015

(65) Prior Publication Data

US 2016/0246227 A1 Aug. 25, 2016

(30) Foreign Application Priority Data

Feb. 24, 2015 (JP) ..... 2015-034485

(51) Int. Cl.
*G03G 15/20* (2006.01)

(52) U.S. Cl.
CPC ..... *G03G 15/2053* (2013.01); *G03G 15/2032* (2013.01); *G03G 15/2067* (2013.01); *G03G 2215/2022* (2013.01); *G03G 2215/2029* (2013.01); *G03G 2215/2038* (2013.01)

(58) Field of Classification Search
CPC ..... G03G 15/2032; G03G 15/2035; G03G 15/2053; G03G 15/2067; G03G 15/2071; G03G 2215/2022; G03G 2215/2025; G03G 2215/2029; G03G 2215/2032; G03G 2215/2035; G03G 2215/2038; G03G 2215/2041
See application file for complete search history.

(56) References Cited

U.S. PATENT DOCUMENTS

| | | | | |
|---|---|---|---|---|
| 7,477,858 | B2 * | 1/2009 | Fujii | G03G 15/2064 399/328 |
| 7,603,069 | B2 * | 10/2009 | Yamana | G03G 15/2064 399/328 |
| 8,208,833 | B2 * | 6/2012 | Kitagawa | G03G 15/2035 399/122 |
| 8,995,895 | B2 * | 3/2015 | Yabuki | G03G 15/2089 399/329 |
| 2007/0212094 | A1 * | 9/2007 | Asakura | G03G 15/2032 399/69 |
| 2007/0217839 | A1 * | 9/2007 | Moteki | G03G 15/2028 399/329 |
| 2010/0226700 | A1 * | 9/2010 | Yamada | G03G 15/2089 399/329 |
| 2012/0237260 | A1 * | 9/2012 | Sengoku | G03G 15/161 399/162 |
| 2012/0275835 | A1 * | 11/2012 | Kuroda | G03G 15/2085 399/329 |
| 2013/0078018 | A1 * | 3/2013 | Yabuki | G03G 15/2017 399/329 |
| 2013/0084088 | A1 * | 4/2013 | Sakai | G03G 15/2064 399/45 |
| 2013/0322941 | A1 * | 12/2013 | Soeda | G03G 15/2053 399/330 |

FOREIGN PATENT DOCUMENTS

JP 2013-073207 A 4/2013

* cited by examiner

*Primary Examiner* — David Gray
*Assistant Examiner* — Carla Therrien
(74) *Attorney, Agent, or Firm* — Mots Law, PLLC

(57) ABSTRACT

A belt unit includes: a belt member; a first pressing member provided to press the belt member; a second pressing member provided to press the belt member; and a driving member configured to change tension applied to the belt member by moving the first pressing member in a first direction and moving the second pressing member in a second direction.

17 Claims, 15 Drawing Sheets

BELT UNIT AND IMAGE FORMATION APPARATUS

CROSS REFERENCE TO RELATED APPLICATIONS

This application claims priority based on 35 USC 119 from prior Japanese Patent Application No. 2015-034485 filed on Feb. 24, 2015, entitled "BELT UNIT AND IMAGE FORMATION APPARATUS", the entire contents of which are incorporated herein by reference.

BACKGROUND OF THE INVENTION

1. Field of the Invention

The disclosure relates to a belt unit and an image formation apparatus including the same.

2. Description of Related Art

There have been heretofore proposed an image formation apparatus including a fixing device which uses a belt to fix developer images on media (see Japanese Patent Application Publication No. 2013-73207, for example).

SUMMARY OF THE INVENTION

Such an image formation apparatus is desired to form high-quality images in which image distortion or any other fault due to deformation or the like of the belt is sufficiently reduced, for example.

An object of an embodiment of the invention is to provide a belt unit and an image formation apparatus suitable for realizing higher-quality images.

A first aspect of the invention is a belt unit that includes: a belt member; a first pressing member provided to press the belt member; a second pressing member provided to press the belt member; and a driving member configured to change tension applied to the belt member by moving the first pressing member in a first direction and moving the second pressing member in a second direction.

A second aspect of the invention is an image formation apparatus that includes the belt unit according to the first aspect.

A third aspect of the invention is a belt unit that includes: a belt member; pressing members configured to press the belt member; and a driving member configured to change tension applied to the belt member by moving each pressing member selectively to one of predetermined positions for each pressing member.

A fourth aspect of the invention is a belt unit that includes: an endless belt; at least one roller provided in contact with the inner circumferential surface of the endless belt, and configured to rotate the endless belt; a first pressing member provided to press the inner circumferential surface of the endless belt; a second pressing member provided to press the inner circumferential surface of the endless belt; and a driving member configured to change tension applied to the endless belt by moving the first pressing member in a first direction and moving the second pressing member in a second direction.

According to the aspect (s) of the invention, the belt unit and image formation apparatus are suitable for realizing high-quality images.

DETAILED DESCRIPTION OF EMBODIMENTS

Hereinafter, a description is given of an embodiment of the invention in detail with reference to the drawings. The following description includes just a specific example of the invention, and the invention is not limited to the mode described below. The invention is not limited to the arrangement, dimensions, and dimensional proportions of components illustrated in each drawing. The description is given in the following order.

1. Embodiment

An image formation apparatus including a fixing device as a belt unit

2. Modification

An image formation apparatus including a transfer device as a belt unit

1. Embodiment

Schematic Configuration

Figure 1A:
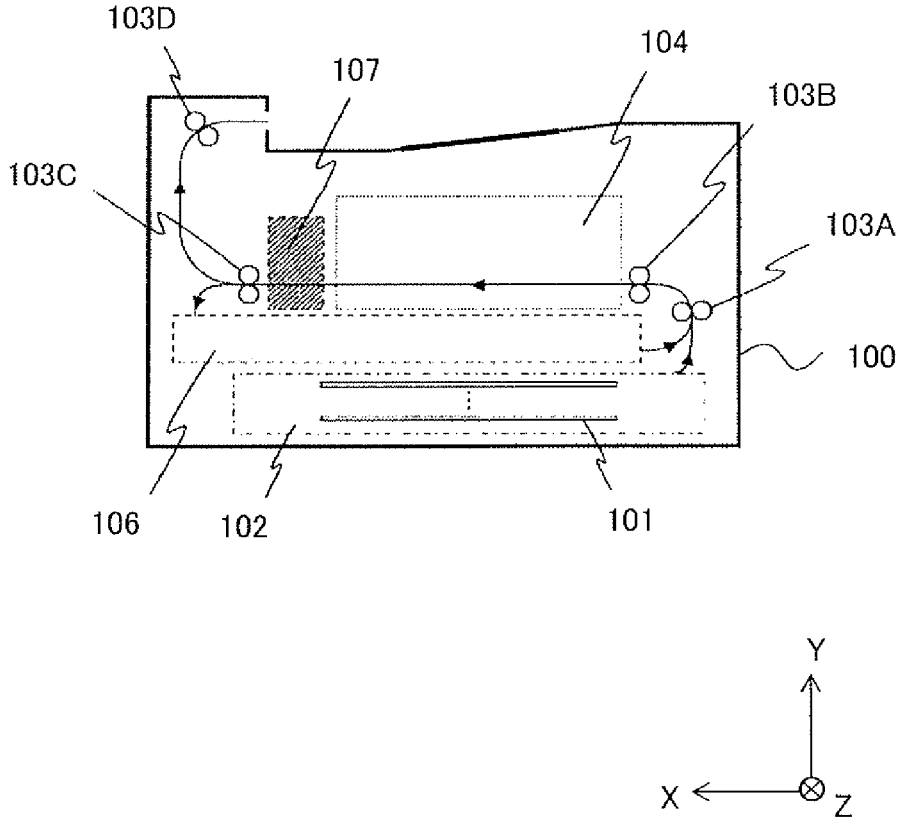
FIG. 1A is a schematic view illustrating an entire configuration example of an image formation apparatus according to a first embodiment of the invention.

FIG. 1A is a schematic view illustrating an entire configuration example of an image formation apparatus including fixing device 107 as a belt unit according to an embodiment of the invention. The image formation apparatus is an electrophotographic printer which forms images (color images, for example) on recording media (also referred to as printing media, transfer materials, or the like) 101 such as paper, for example.

The image formation apparatus includes cassette (paper tray) 102, recording medium conveyance sections 103A to 103D, image formation section 104, recording medium reversing unit 106, and fixing device 107 within housing 100, for example. Cassette 102 accommodates recording media 101. Recording medium conveyance sections 103A to 103D are conveyance rollers configured to convey recording media 101 supplied from cassette 102. Image formation section 104 transfers toner image (developer image) 101T (described later) onto recording media 101. Fixing device 107 is a member configured to fix the toner image transferred onto each recording medium 101 conveyed from image formation section 104 by applying heat and pressure to recording medium 101. Recording medium reversing unit 106 is used in printing on both sides of each recording medium 101. Recording medium 101 with predetermined toner image 101T fixed on one side thereof by fixing device 107 is conveyed through recording medium conveyance section 103C and is reversed by recording medium reversing section 106. Recording medium 101 again passes through recording medium conveyance sections 103A and 103B, image formation section 104, and fixing device 107 so that predetermined toner image 101T is fixed on the other side. Recording medium 101 with both the sides already printed is discharged from recording medium conveyance section 103D through recording medium conveyance section 103C. In the specification, the direction orthogonal to the conveyance direction of recording media 101 is referred to as a transverse direction (the Z-axis direction perpendicular to the page of FIG. 1).

Figure 1B:
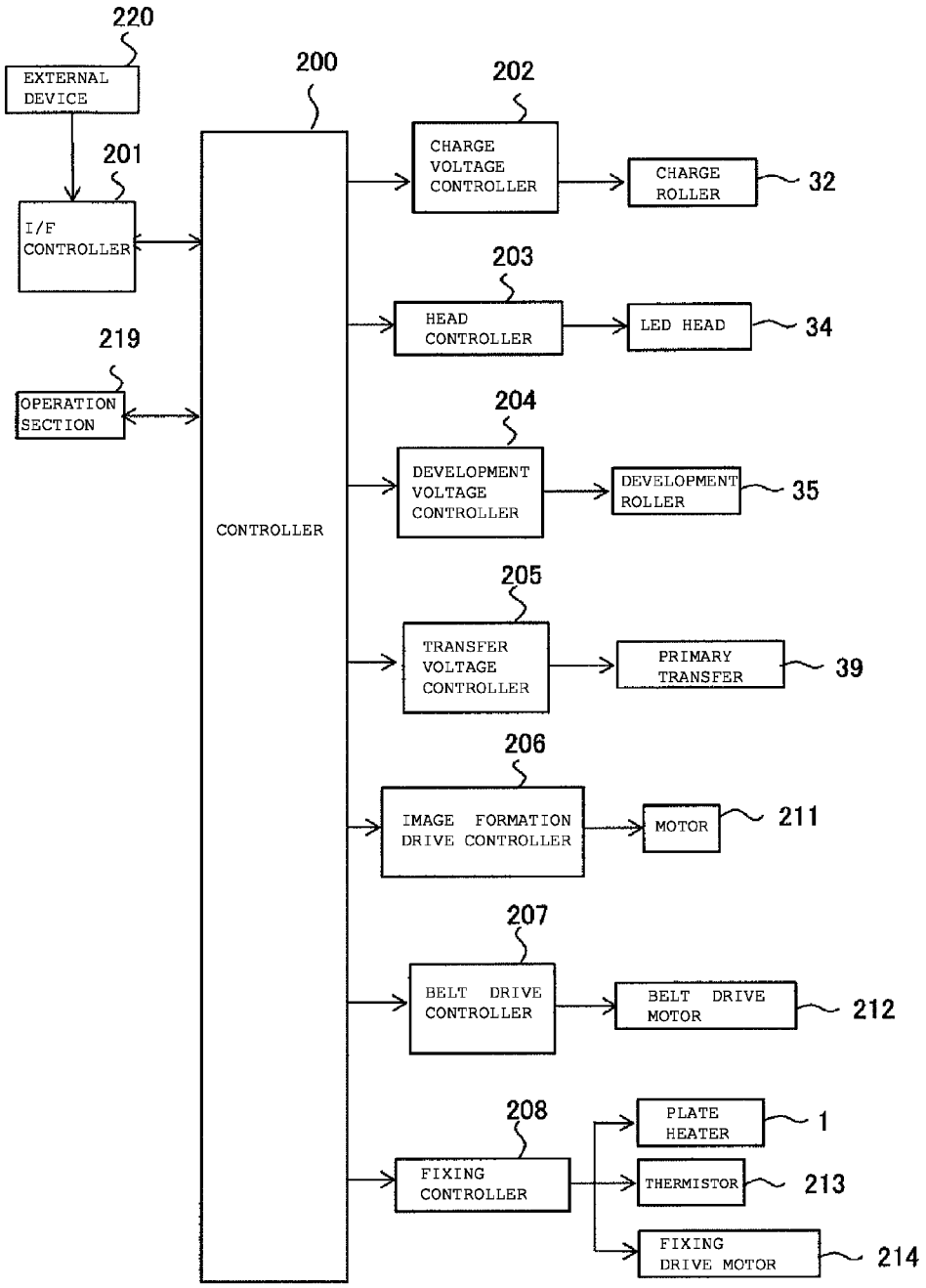
FIG. 1B is a block diagram schematically illustrating a configuration example of the inside of the image formation apparatus illustrated in FIG. 1A.

FIG. 1B is a block diagram schematically illustrating a control system of the image formation apparatus illustrated in FIG. 1A. As illustrated in FIG. 1B, the image formation apparatus includes a main controller 200 controlling the entire operation and also includes I/F controller 201, operation section 219, charge voltage controller 202, head controller 203, development voltage controller 204, transfer voltage controller 205, image formation drive controller 206, belt drive controller 207, and fixing controller 208. The control system of the image formation apparatus is described in detail later.

Figure 1C:
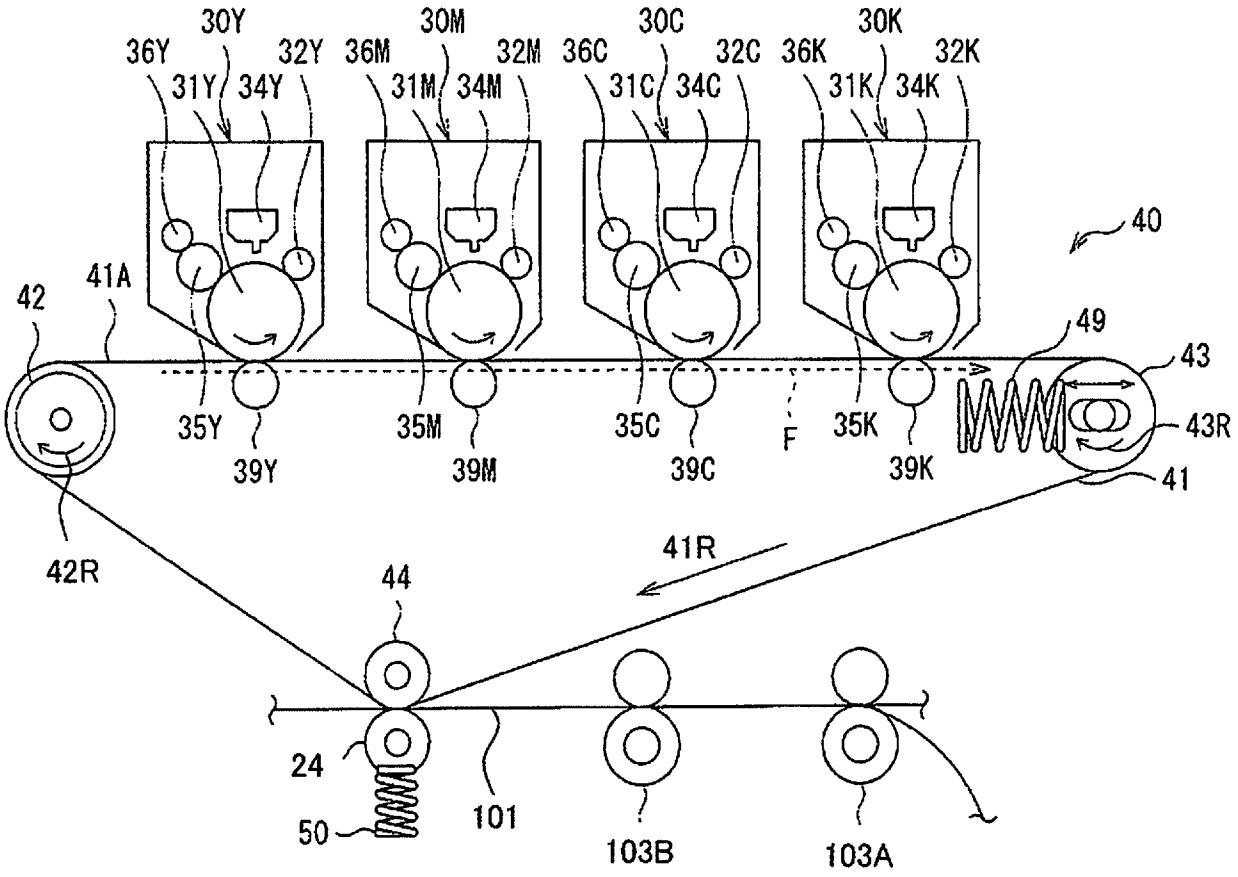
FIG. 1C is an enlarged schematic view illustrating an image formation section of the image formation apparatus illustrated in FIG. 1A.

FIG. 1C is a schematic enlarged view of image formation section 104. Image formation section 104 is described later in detail.

(Detailed Configuration of Fixing Device 107)

With reference to FIGS. 2 to 9, a description is given of the detailed configuration of fixing device 107. Fixing device 107 includes a pair of side plates 20 provided on both ends in the transverse direction. The pair of side plates 20 are fixed to housing 100 of the image formation apparatus, for example.

Figure 2:
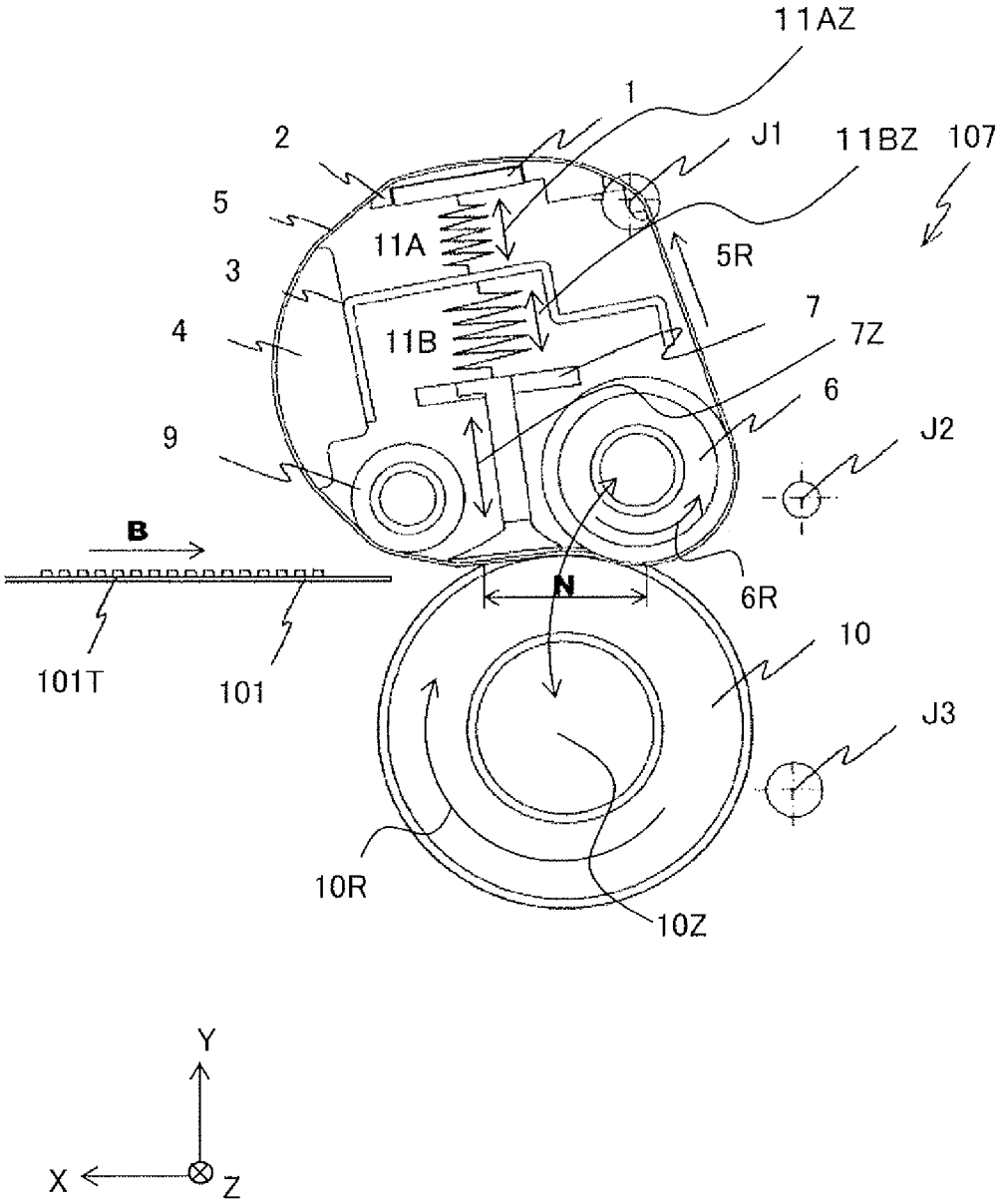
FIG. 2 is a schematic cross-sectional view illustrating a main portion of a fixing device of the image formation apparatus illustrated in FIG. 1.
Figure 3:
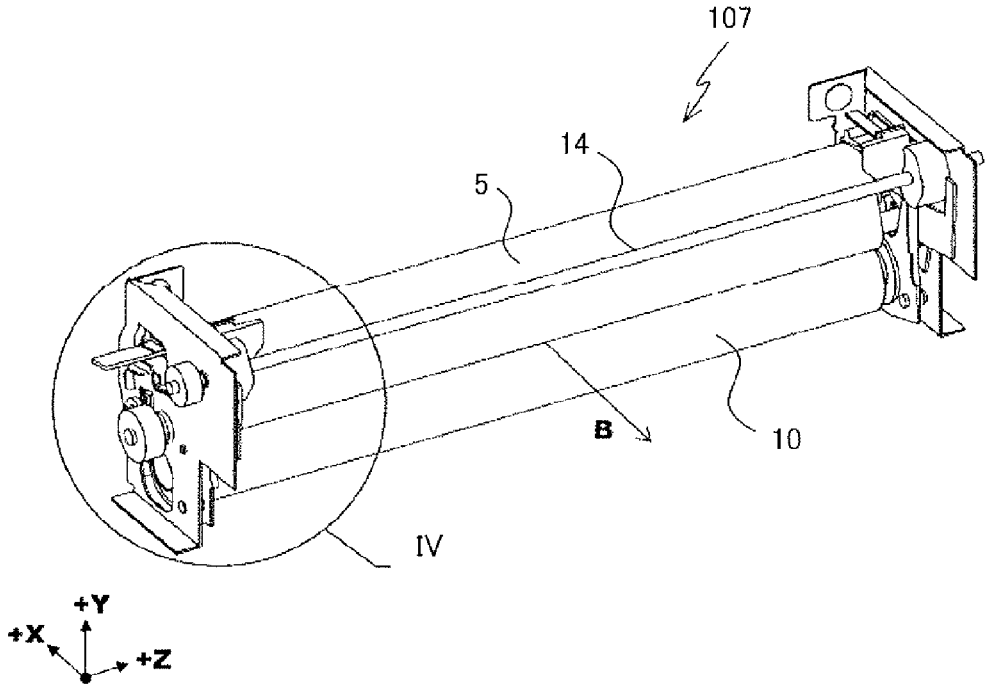
FIG. 3 is a perspective view illustrating the entire configuration of the fixing device of the image formation apparatus illustrated in FIG. 1.
Figure 4:
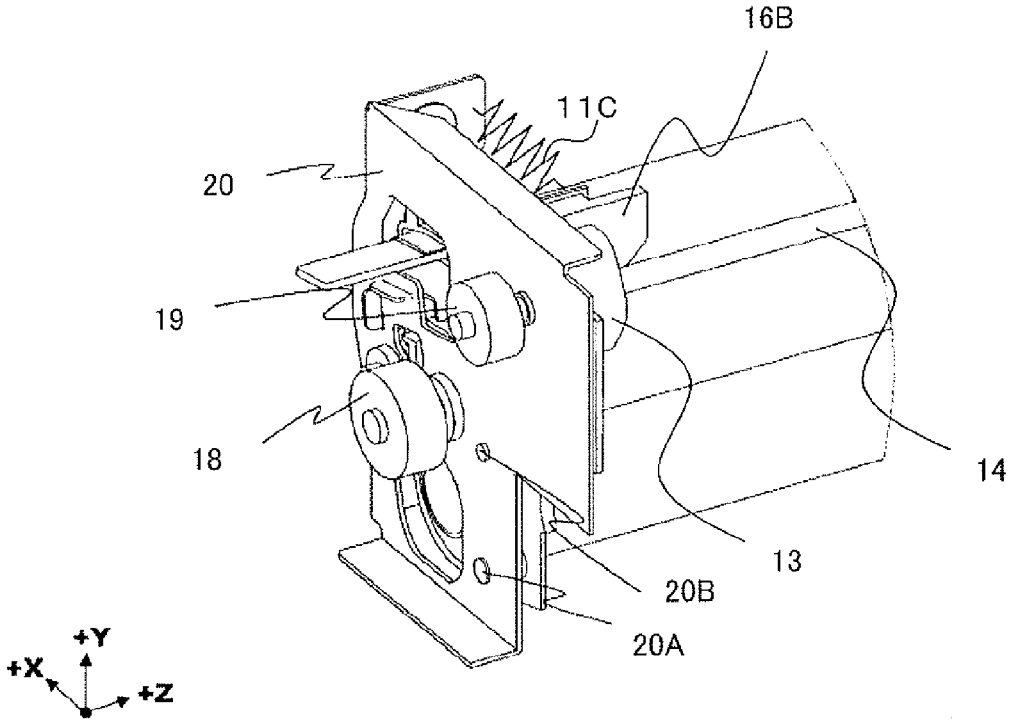
FIG. 4 is an enlarged perspective view illustrating a main part of the fixing device illustrated in FIG. 3.
Figure 5:
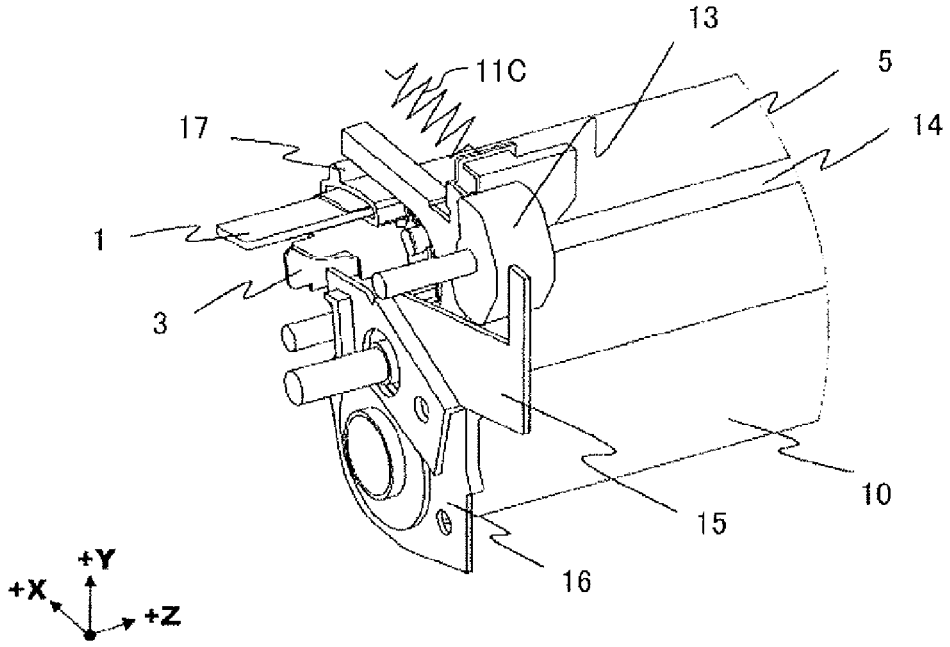
FIG. 5 is another enlarged perspective view illustrating the main part of the fixing device illustrated in FIG. 3.
Figure 6:
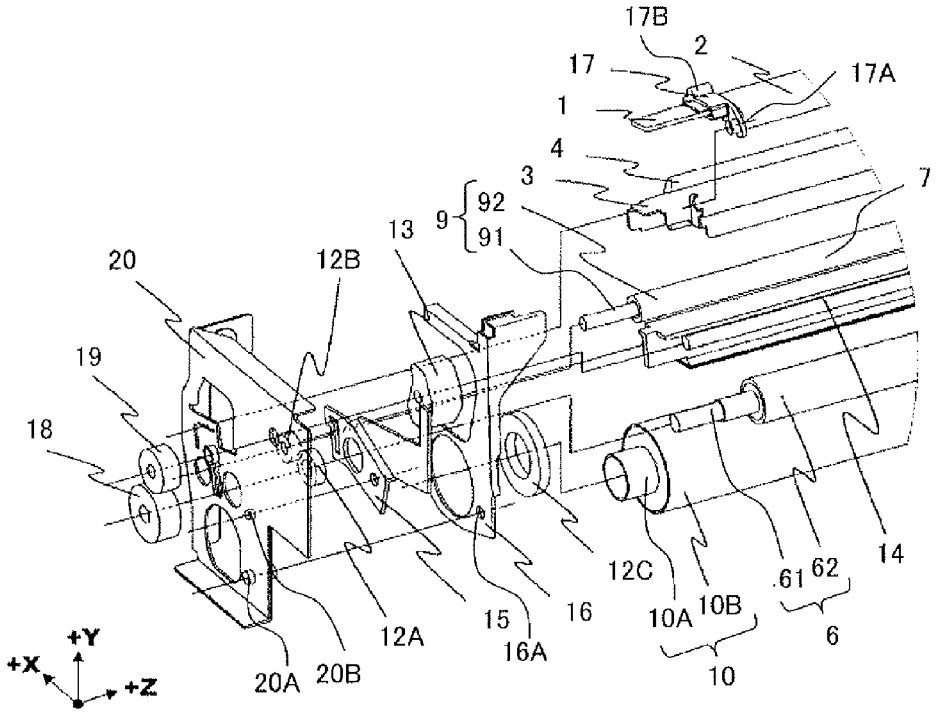
FIG. 6 is an enlarged exploded perspective view illustrating the main portion of the fixing device illustrated in FIG. 3.
Figure 7:
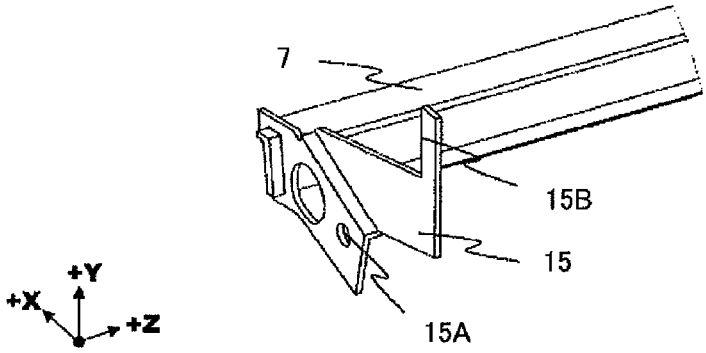
FIG. 7 is an enlarged perspective view illustrating some components of the fixing device illustrated in FIG. 4.
Figure 8:
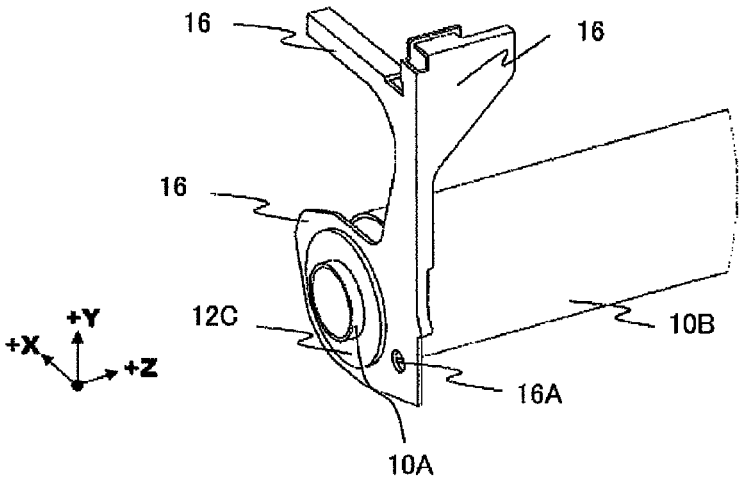
FIG. 8 is an enlarged perspective view illustrating other components of the fixing device illustrated in FIG. 4.
Figure 9:
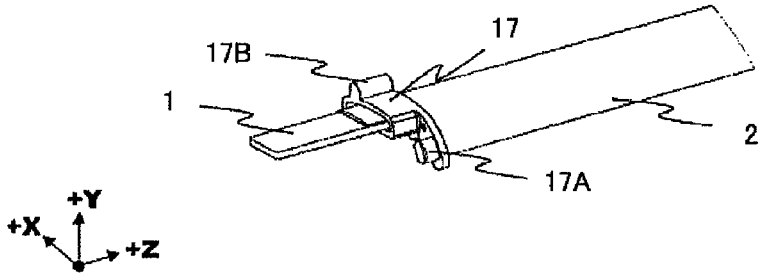
FIG. 9 is an enlarged perspective view illustrating another component of the fixing device illustrated in FIG. 4.

FIG. 2 is a schematic enlarged cross-sectional view illustrating main components of fixing device 107. FIG. 3 is a perspective view illustrating the entire configuration of fixing device 107. FIGS. 4 and 5 are enlarged perspective views illustrating the main part of FIG. 3, but FIG. 5 does not illustrate side plates 20. FIG. 6 is an enlarged exploded perspective view illustrating the main part of fixing device 107. FIGS. 7 to 9 are enlarged perspective views illustrating some of the components constituting fixing device 107.

As illustrated in FIG. 2, fixing device 107 includes annular fixing belt 5, plate heater 1, heat diffusion member 2, support member 3, guide member 4, fixing roller 6, pressure pad 7, and guide roller 9, which are provided in space surrounded by fixing belt 5. Fixing device 107 further includes pressure roller 10 which is located so as to face fixing roller 6 and pressure pad 7 with fixing belt 5 interposed therebetween. Fixing belt 5 is an annular (endless) belt stretched with a predetermined tension across heat diffusion member 2, guide member 4, fixing roller 6, and guide roller 9. Fixing belt 5 is held so as to rotate in a direction of arrow 5R illustrated in FIG. 2. Fixing belt 5 has an inner diameter of about 45 mm, for example, and has a three-layer structure including inner, intermediate, and outer layers. The inner layer is made of polyimide and is 0.1 mm thick, for example. The intermediate layer is made of silicone rubber and is 0.2 mm thick, for example. The outer layer is made of fluorine resin such as polytetrafluoroethylene (PFA). Nip portion N at which fixing belt 5 is in close contact with pressure roller 10 is formed between fixing roller 6 and pressure roller 10 and between pressure pad 7 and pressure roller 10. Each recording medium 101 is conveyed between fixing belt 5 and pressure roller 10, and predetermined toner image 101T is fixed onto recording medium 101 at nip portion N. Fixing belt 5 corresponds to an example of a belt member of the invention.

Plate heater 1 is a plate-shaped member extending in the transverse direction and is a heat source to heat fixing belt 5. Plate heater 1 is in contact with heat diffusion member 2, which surrounds plate heater 1. Plate heater 1 and heat diffusion member 2 rotate together about later-described rotation axis J1. Accordingly, heat is transmitted from plate heater 1 through heat diffusion member 2 to fixing belt 5. Plate heater 1 includes resistance wire inside as a heat generator and generates heat when the resistance wire is supplied with current at a proper timing by an external power supply and controller. The resistance wire is made of a mixture of silver (Ag) and palladium (Pd). Plate heater 1 has a structure in which the resistance wire is stacked on a substrate made of stainless steel. The substrate has a long-side dimension of 350 mm (in the transverse direction), a short-side dimension of 10 mm (orthogonal to the transverse direction), and a thickness of 1 mm. The output of the resistance wire is 1000 Watt (W), for example.

Heat diffusion member 2 is a member extending in the transverse direction along plate heater 1 and is configured to diffuse heat generated by plate heater 1. Heat diffusion member 2 corresponds to an example of a first pressing member of the invention. Heat diffusion member 2 functions to press the circumferential inner surface of fixing belt 5 as described later. Heat diffusion member 2 moves along arrow 11AZ (FIG. 2) by operation of cam 13 (described later) based on an instruction from main controller 200 (FIG. 1B) and functions to control the tension applied to fixing belt 5. Heat generated by plate heater 1 is transmitted to fixing belt 5, which is in contact with heat diffusion member 2, through heat diffusion member 2. Here, semisolid grease or the like which has high heat tolerance and high heat conductivity and is deformable to any shape may be provided between plate heater 1 and heat diffusion member 2. Heat diffusion member 2 is made of aluminum extrusion alloy (JIS A6063) and is 1 mm thick, for example, and the face thereof coming into contact with fixing belt 5 has a circular curve with a curvature radius of about 50 mm.

As illustrated in FIGS. 6 and 9, for example, to each end of heat diffusion member 2, heat diffusion member holder 17 (hereinafter, just referred to as holder 17) is attached. FIGS.

6 and 9 illustrate only a part around an end of heat diffusion member 2. Holder 17 includes projection 17A and contact protrusion 17B. Projection 17A is provided at an end of holder 17 so as to protrude in the Z-axis direction. Projection 17A is rotatably attached to a part of support member 3. Holder 17 rotates about rotational axis J1, which is located at the center of projection 17A. Plate heater 1 and heat diffusion member 2 therefore rotate about rotational axis J1 in a similar manner to holder 17. Contact protrusion 17B is configured to come into contact with contact portion 16C of pressure roller support member 16. Accordingly, contact protrusion 17B is pressed by contact portion 16C when coming into contact with contact portion 16C.

Support member 3 is a member extending in the transverse direction in a similar manner to plate heater 1 and heat diffusion member 2. Each end of support member 3 in the transverse direction is fixed to side plate 20 as illustrated in FIG. 6. Support member 3 holds guide member 4. Support member 3 and side plates 20 are an example corresponding to a supporting section of the invention.

Spring 11A is provided between support member 3 and plate heater 1. Spring 11A includes an end connected to plate heater 1 and the other end connected to support member 3 and is configured to provide biasing force to bias plate heater 1 and support member 3 in the directions of arrow 11AZ (FIG. 2) so as to separate plate heater 1 and support member 3 away from each other. Heat diffusion member 2 is subjected to the biasing force of spring 11A through plate heater 1 and operates to come into contact with the inner circumferential surface of fixing belt 5 and press fixing belt 5 outward. In other words, the biasing force of spring 11A is applied to fixing belt 5 through plate heater 1 and heat diffusion member 2. Fixing belt 5 is thus tightly stretched by being pressed outward under pressing force by heat diffusion member 2.

Between support member 3 and pressure pad 7, spring 11B is provided. Spring 11B includes an end connected to pressure pad 7 and the other end connected to support member 3. Spring 11B is configured to give biasing force to bias pressure pad 7 and support member 3 in directions of arrow 11BZ (FIG. 2) so as to separate pressure pad 7 and support member 3 away from each other. Pressure pad 7 is subjected to the biasing force of spring 11B and operates to come into contact with the inner circumferential surface of a part of fixing belt 5 which is laid between guide roller 9 and fixing roller 6 and to press fixing belt 5 outward. In other words, the biasing force of spring 11B is applied to fixing belt 5 through pressure pad 7. In such a manner, fixing belt 5 is also tightly stretched by being pressed outward under pressing force by pressure pad 7.

Guide member 4 is fixed to support member 3 and functions to guide the path of rotating fixing belt 5 in such a manner that a part of guide member 4 comes into contact with the inner circumferential surface of fixing belt 5.

As illustrated in FIG. 6, fixing roller 6 includes core member 61 extending in the transverse direction and elastic layer 62 covering the circumference of core member 61. Each end of core member 61 is rotatably supported by side plate 20 with rotation bearing 12A interposed therebetween. To an end of core member 61, fixing gear 18 is attached. When fixing gear 18 receives power from a not-illustrated power source, fixing roller 6 thereby rotates in the direction of arrow 6R (FIG. 2). Fixing roller 6 functions to rotate fixing belt 5 in the direction of arrow 5R (FIG. 2) by the surface of elastic layer 62 contacting the inner circumferential surface of fixing belt 5, and guide the path of fixing belt 5. The outer diameter of fixing roller 6 is about 20 mm, for example, and elastic layer 62 is made of silicone sponge and is 2 mm thick, for example.

Guide roller 9 includes core member 91 extending in the transverse direction and elastic layer 92 covering the circumference of core member 91 as illustrated in FIG. 6. Each end of core member 91 is rotatably supported by side plate 20 with rotation bearing 12B interposed therebetween (FIG. 6). The guide roller 9 functions to guide the path of rotating fixing belt 5 in such a manner that the surface of elastic layer 92 comes into contact with the inner circumferential surface of fixing belt 5.

As illustrated in FIGS. 6 and 7, pressure pad 7 is a member extending in the transverse direction, and each end of pressure pad 7 is fixed to pressure pad support member 15. Pressure pad 7 corresponds to an example of a second pressing member of the invention and functions to press the inner circumferential surface of fixing belt 5 as described above. Each pressure pad support member 15 includes hole 15A and cam pressing portion 15B. In hole 15A, post 20B stood on corresponding side plate 20 is inserted (see FIGS. 4 and 6). Hole 15A of pressure pad support member 15 is rotatably supported by side plate 20. Accordingly, pressure pad 7 and pressure pad support member 15 rotate together about rotation axis J2 (FIG. 2), which is located at the center of post 20B. As described above, when being subjected to the biasing force of spring 11B, pressure pad 7 operates to move in the direction of arrow 11BZ (FIG. 2) away from support member 3 and press the fixing belt 5 from the inside to the outside. Cam pressing portion 15B is in or out of contact with cam 13 depending on the position of cam 13. Pressure pad 7 also moves along arrow 11BZ (FIG. 2) by the operation of cam 13 based on an instruction from main controller 200 (FIG. 1B) in a similar manner to heat diffusion member 2, functioning to control the tension applied to fixing belt 5.

Pressure roller 10 is a pressure member provided so as to face fixing roller 6 and pressure pad 7 with fixing belt 5 interposed therebetween. As illustrated in FIGS. 6 and 8, pressure roller 10 includes core member 10A extending in the transverse direction and elastic layer 10B covering the circumference of core member 10A. Each end of core member 10A is rotatably supported by pressure roller support member 16 with rotation bearing 12C interposed therebetween. Pressure roller support member 16 includes hole 16A, cam pressing portion 16B, and contact portion 16C. In hole 16A, post 20A stood on side plate 20 (see FIGS. 4 and 6) is inserted. Hole 16A of pressure roller support member 16 is rotatably supported by side plate 20. Accordingly, pressure roller 10 and pressure roller support member 16 rotate together in the direction of arrow 10Z (FIG. 2) about rotation axis J3 (FIG. 2), which is located at the center of post 20A. Between cam pressing portion 16B of pressure roller support member 16 and a part of side plate 20, spring 11C is provided (see FIG. 4). Spring 11C biases cam pressing portion 16B and side plate 20 to separate cam pressing portion 16B and side plate 20 away from each other. In other words, spring 11C generates a rotational moment about rotation axis J3 so as to press pressure roller 10 against fixing roller 6 and pressure pad 7. Cam pressing portion 16B is a portion that comes into contact with cam 13 depending on the position of the cam 13. Moreover, contact portion 16C is a portion that comes into contact with contact protrusion 17B of holder 17 depending on the position of cam 13.

Pressure roller 10 is driven with rotation of fixing belt 5 interposed between pressure roller 10 and fixing roller 6 and rotates in the direction of arrow 10R illustrated in FIG. 2.

The outer diameter of pressure roller 10 is about 34 mm, for example. Elastic layer 10B is made of silicone sponge and is 2 mm thick, for example. Pressure roller 10 may further include an outer layer which is provided on elastic layer 10B and is made of fluorine resin such as PFA.

Fixing device 107 further includes cam 13, camshaft 14, and cam gear 19 (see FIGS. 4 to 6). Cam 13 is attached to cam shaft 14 rotatably supported by side plate 20 and is positioned between cam pressing portions 15B and 16B. Cam 13 rotates about rotational axis J4 (see FIG. 10 described later) of cam shaft 14 and changes in position. Depending on the position of cam 13, cam 13 is in or out of contact with cam pressing portion 15B or 16B. Cam 13 has a profile in which distance L (L1 to L3) between rotational axis J4 and the outer circumferential surface of cam 13 depends on the location of the outer circumferential surface thereof. To an end of cam shaft 14, cam gear 19 is attached. Cam gear 19 rotates upon receiving power from a not-illustrated driving source and functions to rotate cam shaft 14 and cam 13. With this mechanism, cam pressing portions 15B and 16B are subjected to biasing force in accordance with the position of cam 13. Cam 13 is an example corresponding to a driving member of the invention.

(Detailed Configuration of Image Formation Section 104)

Next, a description is given of image formation section 104 back in FIG. 1C. Image formation section 104 includes image formation units 30Y, 30M, 30C, and 30K, primary transfer rollers 39Y, 39M, 39C, and 39K, secondary transfer roller 24, and transfer belt unit 40, for example.

Image formation units 30Y, 30M, 30C, and 30K individually function as a device to perform development for recording media 101 and are arranged side by side in the direction that recording medium 101 is conveyed. Image formation units 30Y, 30M, 30C, and 30K basically have an identical configuration except for using toners of different colors to form toner images. Specifically, image formation unit 30Y uses yellow (Y: yellow) toner to form an yellow toner image, image formation unit 30M uses a magenta (M: magenta) toner to magenta toner image, image formation unit 30C uses cyan toner (C: cyan) to form a cyan toner image, and image formation unit 30K uses black (K: black) toner to form a black toner image.

Image formation units 30Y, 30M, 30C, and 30K include photoreceptor drums 31Y, 31M, 31C, and 31K, charge rollers 32Y, 32M, 32C, and 32K, and LED (light emitting diode) heads 34Y, 34M, 34C, and 34K, development rollers 35Y, 35M, 35C, and 35K, and supply rollers 36Y, 36M, 36C, and 36K, respectively.

Photoreceptor drums 31Y, 31M, 31C, and 31K are cylindrical members each of which supports an electrostatic latent image on the surface (the surface layer section) and includes a photoreceptor (an organic photoreceptor, for example).

Charge rollers 32Y, 32M, 32C, and 32K are members (charging members) charging the surfaces (the surface layer sections) of photoreceptor drums 31Y, 31M, 31C, and 31K and are arranged in contact with the surfaces (circumferential surfaces) of photoreceptor drums 31Y, 31M, 31C, and 31K, respectively.

Development rollers 35Y, 35M, 35C, and 35K are members supporting toner on the surfaces for development of the electrostatic latent images and are arranged in contact with the surfaces (circumferential surfaces) of photoreceptor drums 31Y, 31M, 31C, and 31K, respectively.

Supply rollers 36Y, 36M, 36C, and 36K are members (supply members) configured to supply toner for development rollers 35Y, 35M, 35C, and 35K and are arranged in contact with the surfaces (circumferential surfaces) of development rollers 35Y, 35M, 35C, and 35K, respectively.

LED heads 34Y, 34M, 34C, and 34K are devices to expose the surfaces of photoreceptive drums 31Y, 31M, 31C, and 31K to form electrostatic latent images on the surfaces (surface layer sections) of photoreceptor drums 31Y, 31M, 31C, and 31K, respectively.

Transfer belt unit 40 includes intermediate transfer belt 41, driving roller 42 configured to drive intermediate transfer belt 41, idle roller 43 as a driven roller, backup roller 44, and biasing member 49 biasing idle roller 43 in a predetermined direction, for example. Driving roller 42, idle roller 43, and backup roller 44 are substantially cylindrical rotatable members which extend in the transverse direction (perpendicular to the page). Transfer belt unit 40 has a mechanism that conveys recording media 101 conveyed from recording medium conveyance section 103B and sequentially transfers toner images formed by respective image formation units 30Y, 30M, 30C, and 30K onto transfer face 41A of intermediate transfer belt 41 in conveyance direction F. Intermediate transfer belt 41 is an endless elastic belt made of a resin material such as polyimide resin, for example. Intermediate transfer belt 41 is tightly stretched (extended in a stretched manner) across driving roller 42, idle roller 43, and backup roller 44 and is configured to cyclically rotate in the direction of arrow 41R, for example.

Driving roller 42 rotates clockwise in the direction of arrow 42R (illustrated in FIG. 1) with power transmitted from belt driving motor 212 (FIG. 1B) and cyclically rotates intermediate transfer belt 41 in the conveyance direction F (the direction of arrow 41R). The operation of belt driving motor 212 is controlled by main controller 200 (FIG. 1B). Idle roller 43 is subjected to biasing force of biasing member 49 to adjust the tension applied to intermediate transfer belt 41.

Secondary transfer roller 24 constitutes a secondary transfer section in conjunction with backup roller 44. Secondary transfer roller 24 and backup roller 44 are provided so as to face each other with intermediate transfer belt 41 interposed therebetween. Secondary transfer roller 24 is biased toward backup roller 44 with biasing member 50 such as a coil spring. An end of biasing member 50 is fixed to housing 100 of the image formation apparatus. Secondary transfer roller 24 is therefore pressed against backup roller 44 with intermediate transfer belt 41 interposed therebetween. Backup roller 44 and secondary transfer roller 24 constitute the secondary transfer section which transfers toner images on transfer face 41A of intermediate transfer belt 41 onto recording media 101.

(Control System of Image Formation Apparatus)

Next, a description is given of a control system of the image formation apparatus back in FIG. 1B.

Main controller 200 includes a microprocessor, a ROM, a RAM, an input/output port, and a timer, for example. Main controller 200 receives print data and a control command from an external device such as a personal computer and performs the sequence control for the image formation apparatus.

I/F controller 201 transmits information of the image formation apparatus to external device 220. I/F controller 201 also analyzes a command transmitted from external device 220 and processes data transmitted from external device 220.

Charge voltage controller 202 performs control to apply charge voltage to charge rollers 32 (32Y, 32M, 32C, and 32K) upon an instruction of main controller 200.

Head controller 203 performs, upon an instruction of main controller 200, control to drive LED heads 34 (34Y, 34M, 34C, and 34K) in accordance with print data in order to expose the surfaces of photoreceptor drums 31 (31Y, 31M, 31C, and 31K) and form electrostatic latent images.

Development voltage controller 204 performs, upon an instruction of main controller 200, control to apply development voltage to development rollers 35 (35Y, 35M, 35C, and 35K) in order to develop the electrostatic latent images formed on the surfaces of photoreceptor drums 31 (31Y, 31M, 31C, and 31K).

Transfer voltage controller 205 performs, upon an instruction of main controller 200, control to apply transfer voltage to primary transfer rollers 39 (39Y, 39M, 39C, and 39K) in order to transfer toner images formed on the surfaces of photoreceptor drums 31Y, 31M, 31C, and 31K to recording media 101.

Image formation drive controller 206 performs, upon an instruction of main controller 200, control to drive motors 211 (211Y, 211M, 211C, and 211K) in order to drive and rotate photoreceptor drums 31Y, 31M, 31C, and 31K.

Belt drive controller 207 performs, upon an instruction of main controller 200, control to drive belt drive motor 212 in order to rotate driving roller 42 (described later) and move intermediate transfer belt 41.

Fixing controller 208 receives detected temperature from thermistor 213, which is configured to detect the temperature of fixing device 107, and performs on-off control of power supply to plate heater 1 of fixing device 107. Fixing controller 208 performs control to drive fixing drive motor 214, which rotates fixing roller 6 of fixing device 107, upon an instruction of main controller 200. Fixing controller 208 further drives drive motor 215 to rotate cam gear 19 and control the position of cam 13 upon an instruction of main controller 200. In other words, upon an instruction of main controller 200 (FIG. 1B), fixing controller 208 drives cam 13 to move heat diffusion member 2 and pressure pad 7 close to each other or away from each other, controlling the tension applied to fixing belt 5. Pressure roller 10 and fixing belt 5 in contact with fixing roller 6 are driven and rotated by fixing roller 6.

Main controller 200 is connected to operation section 219 with which a user inputs the type of recording media 101. Based on the type of recording media 101 inputted by the user with the operation section 219, main controller 200 causes fixing controller 208 to execute control of the position of cam 13.

Operation and Effect (A. Basic Operation)

In the image formation apparatus, toner images are transferred to recording media 101 in the following manner.

Specifically, as illustrated in FIG. 1, first, recording media 101 accommodated in cassette 102 are picked up one by one from the top with a not-illustrated paper feed roller and fed toward recording medium conveyance section 103A located downstream. Subsequently, recording media 101 fed from the paper feed roller are conveyed to image formation section 104 located downstream while the skew of recording media 101 is being corrected by recording medium conveyance sections 103A and 103B. In image formation section 104, toner images are transferred onto recording media 101 in the following manner.

In image formation section 104, a toner image of each color is formed by the electrophotographic process described below. Specifically, the surface of photoreceptor drum 31 is uniformly charged by charge roller 32 supplied with predetermined application voltage, for example. Next, the surface of photoreceptor drum 31 is irradiated with irradiation light from LED head 34 for exposure, and an electrostatic latent image in accordance with a print pattern is therefore formed on photoreceptor drum 31. Moreover, toner from development roller 35 is attached to the electrostatic latent image on the photoreceptor drum 31. The toner (toner image) on the photoreceptor drum 31 is transferred to intermediate transfer belt 41 by the electric field between photoreceptor drum 31 and primary transfer roller 39 located facing photoreceptor drum 31. In the secondary transfer section, the toner image on transfer face 41A of intermediate transfer belt 41 is then transferred to recording media 101.

Thereafter, the toner (toner images) on the recording media 101 is fixed by application of heat and pressure at fixing device 107. Recording media 101 with the toner fixed are discharged out of the image formation apparatus through recording medium conveyance sections 103C and 103D.

(B. Operation of Fixing Device 107)

The operation of fixing device 107 is classified into three modes: normal print mode, special print mode, and stand-by mode depending on the position of cam 13. In the case where the outer circumferential surface of cam 13 is in contact with cam pressing portion 15B so that cam pressing portion 15B is subjected to biasing force from cam 13, pressure pad support member 15 is biased so as to rotate about rotation axis J2. Pressure pad support member 15 therefore biases pressure pad 7 in the +Y direction (see FIG. 2). In other words, cam 13 operates in such a direction to loosen the tension of fixing belt 5. In the case where the outer circumferential surface of cam 13 is in contact with cam pressing portion 16B so that cam pressing portion 16B is subjected to biasing force from cam 13, pressure roller support member 16 is biased to rotate about rotation axis J3. Pressure roller support member 16 therefore biases pressure roller 10 (together with heat diffusion member 2 in some cases) in the −Y direction (see FIG. 2). Cam 13 operates in such a direction to loosen the tension of fixing belt 5 also in this case.

On the other hand, the outer circumferential surface of cam 13 is out of contact with cam pressing portion 15B so that cam pressing portion 15B is not subjected to biasing force from cam 13, pressure pad support member 15 does not move. Accordingly, cam 13 does not act on pressure pad 7. In this case, pressure pad 7 is biased by spring 11B in a direction away from support member 3 (in the −Y direction) (see FIG. 2). The tension of fixing belt 5 is therefore increased, so that fixing belt 5 is tightly stretched. Similarly, in the case where the outer circumferential surface of cam 13 is out of contact with cam pressing portion 16B so that cam pressing portion 16B is not subjected to biasing force from cam 13, pressure roller support member 16 does not move. Accordingly, cam 13 does not act on pressure roller 10 and heat diffusion member 2. In this case, heat diffusion member 2 is biased by spring 11A in a direction away from support member 3 (in the +Y direction) (see FIG. 2). The tension of fixing belt 5 is therefore increased, so that fixing belt 5 is tightly stretched.

As described above, in fixing device 107, the tension applied to fixing belt 5 is changed by using cam 13 to move heat diffusion member 2 in the −Y direction and move pressure pad 7 in the +Y direction. Cam 13 is configured to loosen fixing belt 5 by changing in position to move heat diffusion member 2 in the −Y direction and move pressure pad 7 in the +Y direction. Accordingly, fixing belt 5 can be loosened when the film formation apparatus does not perform printing in stand-by mode. Fixing belt 5 is therefore less likely to be partly deformed or deteriorated. Accordingly, the image formation apparatus with the thus-configured fixing device 107 mounted thereon realizes high-quality images in which distortion or any other fault due to deterioration of fixing belt 5 is sufficiently reduced. Herein, the +Y and −Y directions are examples corresponding to first and second directions of the invention.

When the image formation apparatus is powered on, fixing controller 208 powers on plate heater 1 upon an instruction of main controller 200. Plate heater 1 thereby generates heat. The heat generated by plate heater 1 is transmitted to fixing belt 5 through heat diffusion member 2. Fixing controller 208 performs on-off control of power supply to plate heater 1 based on the temperature of fixing belt 5 detected by thermistor 213 so as to keep the temperature of fixing belt 5 almost constant.

Hereinafter, a description is given of each operation mode of fixing device 107 in detail.

(Normal Print Mode)

Figure 10:
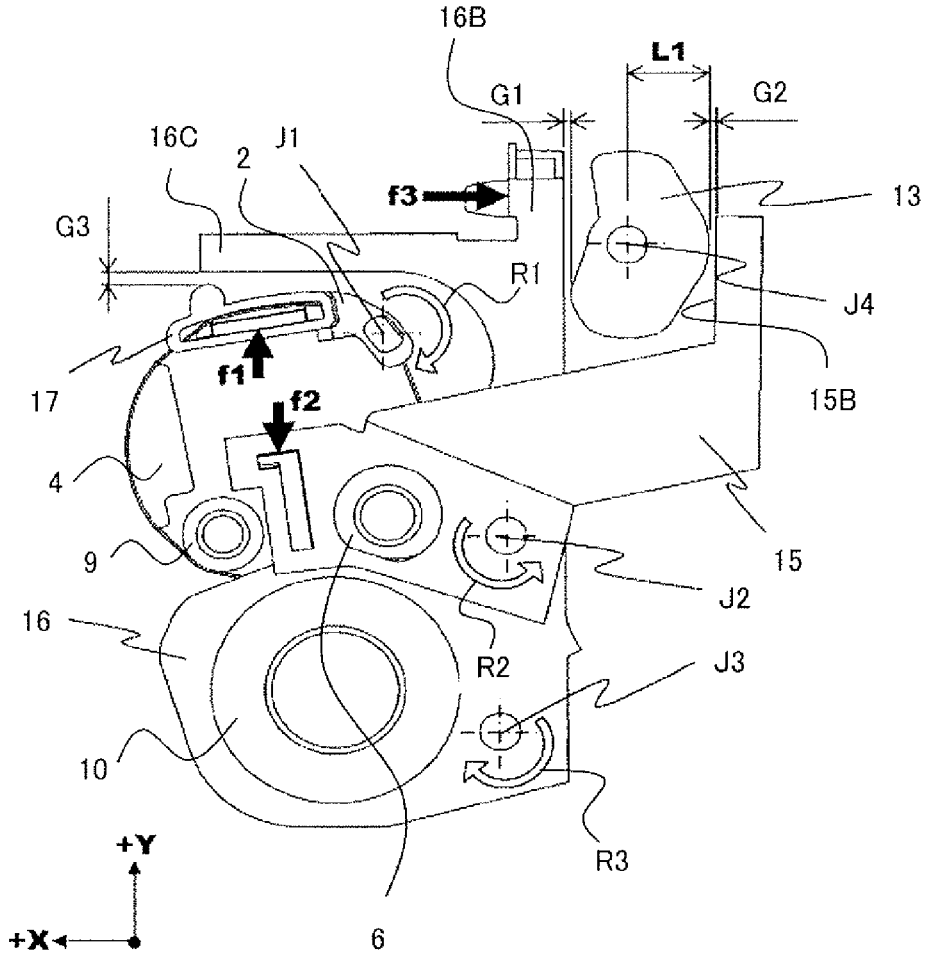
FIG. 10 is a side view for explaining a first operation of the fixing device illustrated in FIG. 3.
Figure 11:
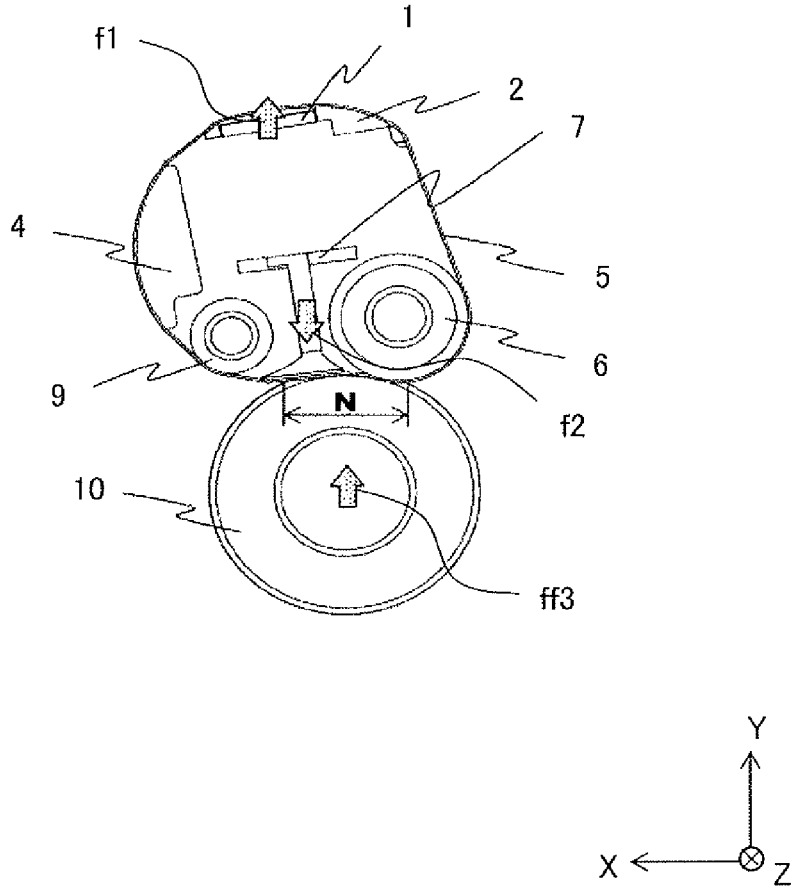
FIG. 11 is a schematic configuration diagram for explaining the first operation of the fixing device illustrated in FIG. 3.

With reference to FIGS. 10 and 11, the normal print mode is described. Main controller 200 identifies the type of recording media 101 and then performs the following operation when the recording media 101 are normal media (other than special media such as easily-wrinkled envelopes, thin paper, and powder paper). Specifically, cam gear 19 is rotated by a driving source to rotate cam shaft 14 so that cam 13 is held at the position illustrated in FIG. 10. Cam 13 is held at such a position that cam 13 is out of contact with both of cam pressing portion 15B of pressure pad support member 15 and cam pressing portion 16B of pressure roller support member 16. At this position, gap G2 is formed between the outer circumferential surface of cam 13 and cam pressing portion 15B, and gap G1 is formed between the outer circumferential surface of cam 13 and cam pressing portion 16B. Accordingly, neither pressure pad support member 15 nor pressure roller support member 16 is subjected to biasing force of cam 13. Moreover, gap G3 is formed between contact portion 16C of pressure roller support member 16 and contact protrusion 17B of holder 17. Accordingly, heat diffusion member 2 is not subjected to biasing force of cam 13.

In pressure roller support member 16, cam pressing portion 16B is subjected to biasing force f3 of spring 11C. This generates a rotational moment about rotation axis J3 in a direction of arrow R3 (FIG. 10) in pressure roller support member 16. Pressure roller 10 is subjected to biasing force ff3 in the +Y direction as illustrated in FIG. 11 and is pressed against pressure pad 7 and fixing roller 6 with fixing belt 5 interposed therebetween.

Heat diffusion member 2 is subjected to biasing force f1 of spring 11A in the +Y direction. Heat diffusion member 2 therefore presses the inner circumferential surface of fixing belt 5 in the +Y direction. On the other hand, pressure pad 7 is subjected to biasing force f2 of spring 11B in the −Y direction. Pressure pad 7 therefore presses the inner circumferential surface of fixing belt 5 in the −Y direction. Fixing belt 5 is pressed by heat diffusion member 2 and pressure pad 7 outward. Accordingly, fixing belt 5 increases intension and is tightly stretched.

Nip portion N is therefore formed between a portion of fixing belt 5 stretched between fixing roller 6 and pressure pad 7 and pressure roller 10 facing the same portion (see FIG. 11).

(Special Print Mode)

Figure 12:
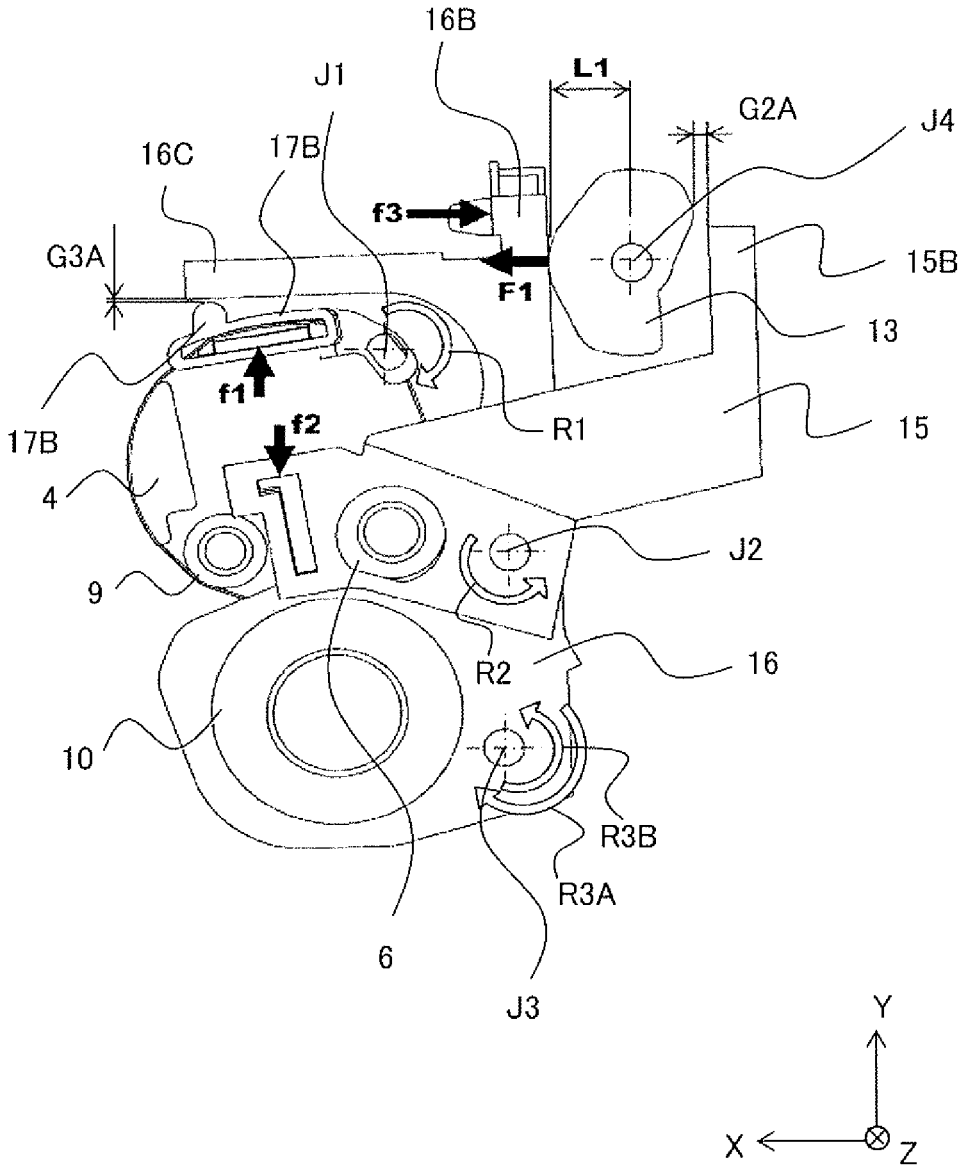
FIG. 12 is a side view for explaining a second operation of the fixing device illustrated in FIG. 3.
Figure 13:
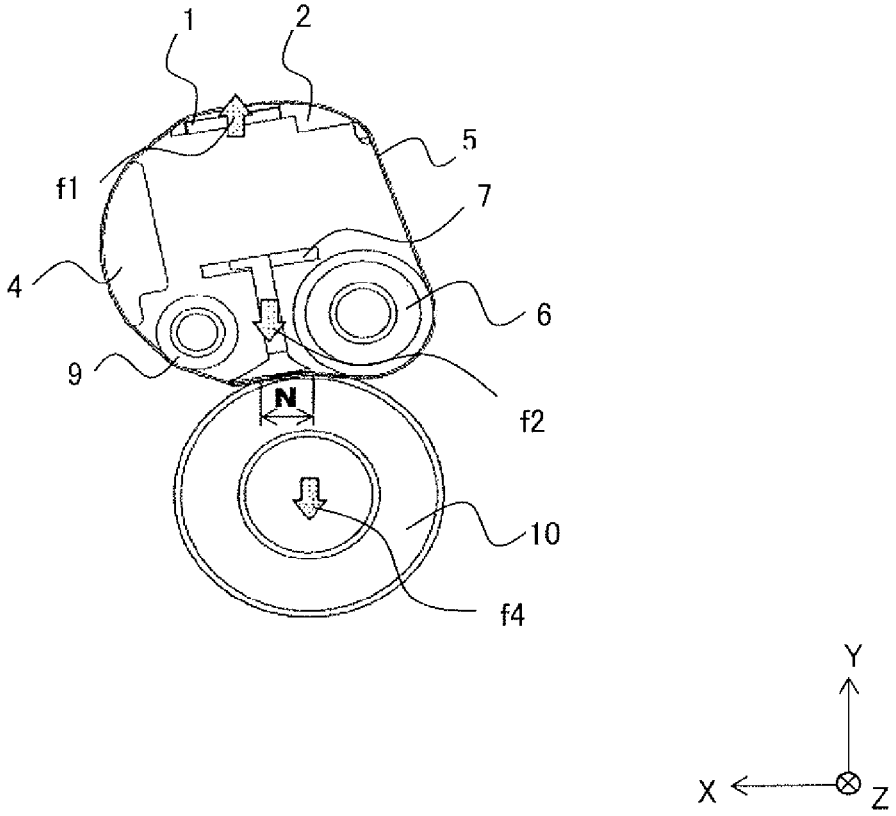
FIG. 13 is a schematic configuration diagram for explaining the second operation of the fixing device illustrated in FIG. 3.

Next, with reference to FIGS. 12 and 13, the special print mode is described. The special print mode is a mode performed when fixing operation is performed for special media such as easy-wrinkled envelopes, thin paper, and powder paper. When main controller 200 determines that recording media 101 are special media, the following operation is performed. Specifically, cam gear 19 is rotated with a driving source to rotate cam shaft 14 so that cam 13 is held at the position illustrated in FIG. 12. Cam 13 is held at such a position that a part of the outer circumferential surface thereof is in contact with cam pressing portion 16B while no other part of the outer circumferential surface thereof is in contact with cam pressing portion 15B. At this position, gap G2A (>G2) is formed between the outer circumferential surface of cam 13 and cam pressing portion 15B, and pressure pad support member 15 is not subjected to biasing force. On the other hand, cam pressing portion 16B is in contact with the outer circumferential surface of cam 13 and is therefore subjected to biasing force F1 from cam 13 in the +X direction. Herein, the distance between rotational axis J4 and the point of contact between the outer circumferential surface of cam 13 and cam pressing portion 16B is referred to as L1. Cam pressing portion 16B is subjected to biasing force f3 in the −X direction, which is opposite to that of biasing force F1, by operation of spring 11C. In pressure roller support member 16, a rotational moment in the direction of arrow R3A and a rotational moment in the direction of arrow R3B are therefore generated about rotational axis J3. Herein, the rotational moment in the direction of arrow R3B is larger than the rotational moment in the direction of arrow R3A. Accordingly, pressure roller 10 is subjected to biasing force f4 (=F1−f3) in the −Y direction as illustrated in FIG. 13. Pressure roller 10 is located at a position a little shifted from the position in the normal print mode (FIGS. 10 and 11) in a direction (in the −Y direction) away from fixing roller 6 and pressure pad 7.

In the special print mode, gap G3A (<G3) is formed between contact portion 16C of pressure roller support member 16 and contact protrusion 17B of holder 17 in a similar manner to the normal print mode. Heat diffusion member 2 is therefore not subjected to biasing force from cam 13.

In the special print mode, in a similar manner to the normal print mode, heat diffusion member 2 is subjected to biasing force f1 from spring 11A in the +Y direction while pressure pad 7 is subjected to biasing force f2 of spring 11B in the −Y direction. Heat diffusion member 2 therefore presses the inner circumferential surface of fixing belt 5 in the +Y direction, and pressure pad 7 presses the inner circumferential surface of fixing belt 5 in the −Y direction. Fixing belt 5 is pressed outward under pressing force by heat diffusion member 2 and pressure pad 7. Fixing belt 5 increases in tension and is therefore tightly stretched. As described above, since pressure roller 10 facing pressure pad 7 is located at the position a little shifted in the −Y direction, pressure pad 7 is also located at a position a little shifted from the position in the normal print mode in the −Y direction, following pressure roller 10. Accordingly, the force with which pressure roller 10 presses fixing belt 5 is smaller (the nip pressure is lower) in the special print mode than that in the normal print mode (FIG. 11) as illustrated in FIG. 13, and the range of nip portion N is narrower. In the special print mode, nip portion N is narrowed, and the nip pressure is lowered. This can prevent recording media 101 from wrinkling during the fixing operation.

(Stand-by Mode)

Figure 14:
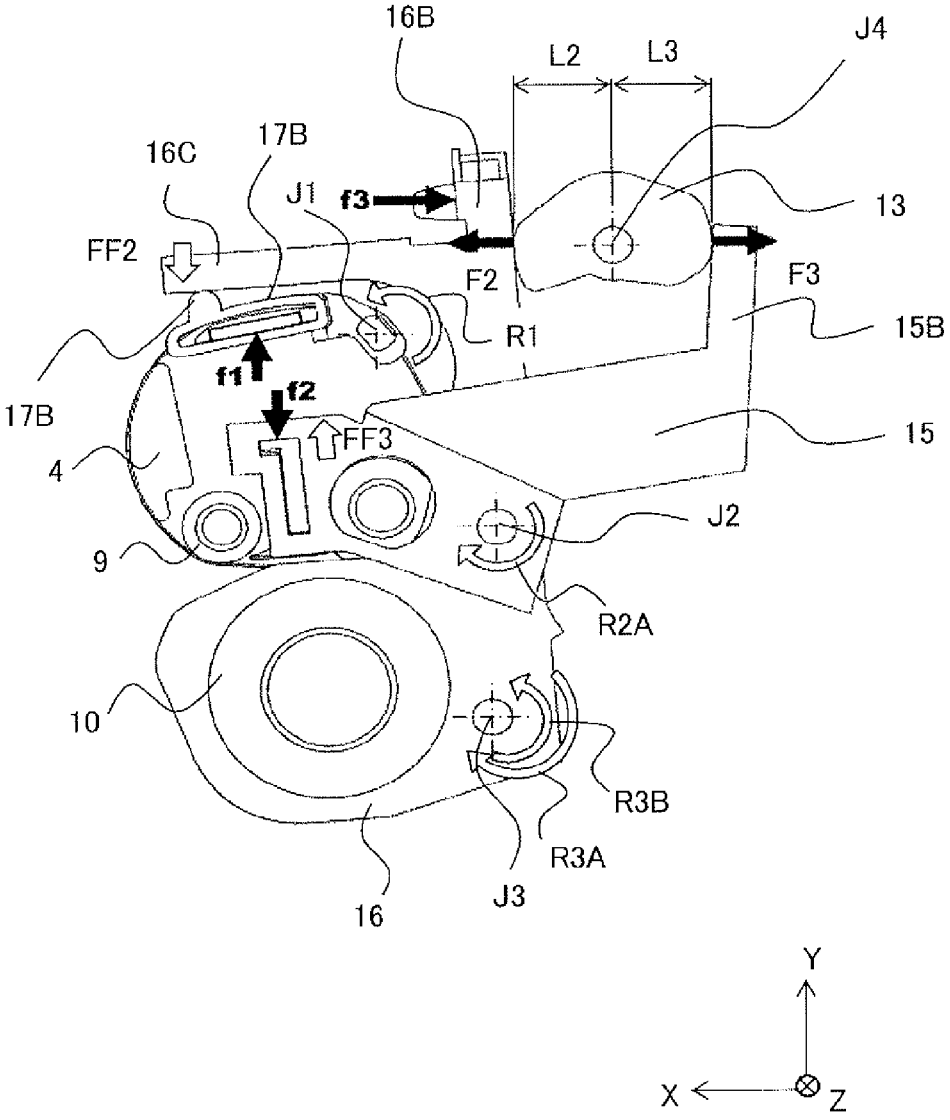
FIG. 14 is a side view for explaining a third operation of the fixing device illustrated in FIG. 3.
Figure 15:
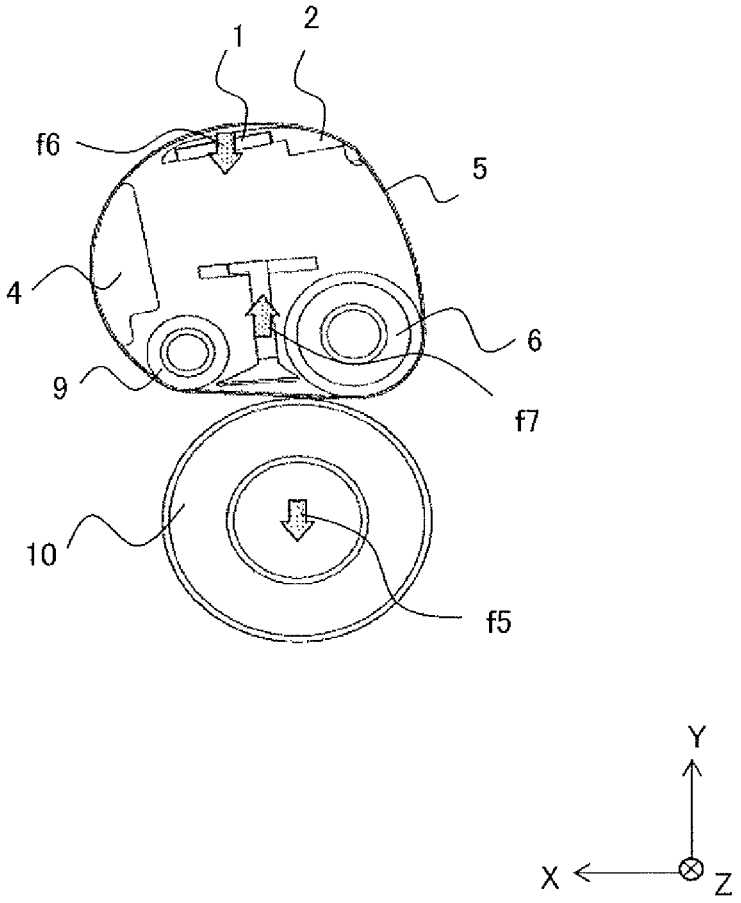
FIG. 15 is a schematic configuration diagram for explaining the third operation of the fixing device illustrated in FIG. 3.

Next, with reference to FIGS. 14 and 15, the stand-by mode (non-operation mode) is described. The stand-by mode is a mode corresponding to the state where the image formation apparatus does not perform fixing operation for recording media 101. When main controller 200 determines that the image formation apparatus does not perform fixing operation for recording media 101, the following operation is performed. Specifically, cam gear 19 is rotated with a driving source to rotate cam shaft 14 so that cam 13 is held at the position illustrated in FIG. 14. In other words, cam 13 is held at the position where cam 13 is in contact with both of cam pressing portion 15B of pressure pad support member 15 and cam pressing portion 16B of pressure roller support member 16.

Cam pressing portion 16B is in contact with the outer circumferential surface of cam 13 and is subjected to biasing force F2 from cam 13 in the +X direction. Herein, the distance between rotational axis J4 and the point of contact between the outer circumferential surface of cam 13 and cam pressing portion 16B is indicated by L2 (>L1). Cam pressing portion 16B is further subjected to biasing force f3 in the −X direction opposite to biasing force F2 by the operation of spring 11C. Accordingly, in the pressure roller support member 16, a rotational moment in the direction of arrow R3A and a rotational moment in the direction of arrow R3B are generated about rotational axis J3. Herein, the rotational moment of arrow R3B is larger than the rotational moment in the direction of arrow R3A. Pressure roller 10 is therefore subjected to biasing force f5 (=F2−f3) in the −Y direction as illustrated in FIG. 15. Distance L2 is larger than distance L1 in the special print mode illustrated in FIG. 12. Biasing force F2 is therefore larger than biasing force F1 in the special print mode illustrated in FIG. 12, and biasing force f5 (FIG. 15) is larger than biasing force f4 (FIG. 13). Pressure roller 10 is therefore located at the position further shifted from the position in the special print mode (FIGS. 12 and 13) in the direction (in the −Y direction) away from fixing roller 6 and pressure pad 7.

Cam pressing portion 15B is in contact with the outer circumferential surface from cam 13 and is subjected to biasing force F3 of cam 13 in the −X direction. Herein, the distance between rotational axis J4 and the point of contact between the outer circumferential surface of cam 13 and cam pressing portion 15B is indicated by L3. In pressure pad support member 15, a rotational moment in the direction of arrow R2A is generated about rotational axis J2 by cam 13. Pressure pad 7 fixed to an end of pressure pad support member 15 is subjected to biasing force FF3 in the +Y direction. Pressure pad 7 is further subjected to biasing force f2 in the −Y direction opposite to biasing force FF3 by the operation of spring 11B. Since biasing force FF3 is larger than biasing force f2, pressure pad 7 is subjected to biasing force f7 (=FF3−f2) in the +Y direction, for example, as illustrated in FIG. 15. Accordingly, pressure pad 7 is out of contact with the inner circumferential surface of fixing belt 5 as illustrated in FIG. 15.

In the stand-by mode, unlike the normal print mode, the contact portion 16C of pressure roller support member 16 is in contact with contact protrusion 17B of holder 17 by the rotational moment generated about rotational axis J3 in the direction of arrow R3B in pressure roller support member 16. Holder member 17 and heat diffusion member 2 are subjected to biasing force FF2 from contact portion 16C. Since biasing force FF2 is larger than biasing force f1 due to spring 11A, holder 17 and heat diffusion member 2 are subjected to biasing force f6 (=FF2−f1) in the −Y direction, for example, as illustrated in FIG. 15. Accordingly, as illustrated in FIG. 15, heat diffusion member 2 is shifted in a direction away from the inner circumferential surface of fixing belt 5.

As described above, in the stand-by mode, nip portion N is not formed, and fixing belt 5 is not pressed by heat diffusion member 2 and pressure pad 7. The fixing belt 5 is therefore loosened (FIG. 15).

(C. Effect)

As described above, in fixing device 107 of the embodiment, by controlling the position of cam 13, the transition between the normal print mode and special print mode in which printing of recording media 101 is performed and the stand-by mode in which printing of recording media 101 is not performed can be made. Fixing belt 5 is therefore less likely to be partly deformed or deteriorated, which thus increases the life of fixing belt 5. Accordingly, the image formation apparatus with fixing device 107 mounted thereon can provide high-quality images, in which distortion or any other fault due to deterioration of fixing belt 5 is sufficiently reduced, for a long period of time.

Especially in the embodiment, heat diffusion member 2 and pressure pad 7 are simultaneously moved in opposite directions by rotating cam 13 upon an instruction of main controller 200, for example. This simplifies the state transition (switching) between the stretched state and loosened state of fixing belt 5.

2. Modifications

Hereinabove, the invention is described using the embodiment. However, the invention is not limited to the above-described embodiment of the invention and can be variously changed. In the embodiment, for example, the image formation apparatus is configured to form color images. The invention is not limited to such a color image formation apparatus. The image formation apparatus may be an image formation apparatus which forms monochrome images by transferring only black toner images, for example. In the embodiment described above, the image formation apparatus is the intermediate transfer-type. However, the invention is applicable to direct transfer-type.

In the example described in the aforementioned embodiment, the invention is applied to the fixing device as the belt unit. However, the invention is not limited to the fixing device. The invention is applicable to a transfer device such as transfer belt unit 40, for example. In this case, for example, intermediate transfer belt 41 corresponds to an example of the belt member of the invention, and driving roller 42 and idle roller 43 correspond to examples of the first pressing member and second pressing member, respectively. Moreover, the transfer device may further include a cam corresponding to cam 13 and may be configured to change the tension applied to intermediate transfer belt 41 by moving driving roller 42 and idle roller 43 in predetermined directions. Intermediate transfer belt 41 is therefore less likely to be partly deformed or deteriorated, which thus increases the life of intermediate transfer belt 41. Accordingly, the image formation apparatus with thus-configured intermediate transfer belt 41 mounted thereon can provide high-quality images, in which distortion or any other fault due to deterioration of intermediate transfer belt 41 is sufficiently reduced, for a long period of time.

Moreover, in the aforementioned embodiment, the belt unit (fixing device 107) includes one belt member (fixing belt 5) and two pressing members (heat diffusion member 2 and pressure pad 7) for the one belt member, and the tension of the one belt member is controlled by moving the two pressing members. However, the invention is not limited to the thus-configured belt unit. For example, the belt unit may include three pressing members provided for the one belt member and may be configured to control the tension of the belt member by moving the three pressing members. Moreover, the belt unit may include plural belt members and plural pressing members that press each of the plural belt members. The tension applied to each belt member is controlled by moving the plural pressing members.

In the aforementioned embodiment and modifications, the LED heads including light-emitting diodes as light sources are used as the exposure device. Instead, an exposure device including a laser device or the like as the light source may be used, for example.

Furthermore, in the embodiment and modifications, the image formation apparatus having a printing function is described as an example of the image formation apparatus of the invention. However, the invention is not limited to that described above. The invention is applicable to image formation apparatuses functioning as multifunction apparatuses including scanning and fax functions in addition to the printing function.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A belt unit, comprising:

a belt member;

a first pressing member provided to press the belt member;

a second pressing member provided to press the belt member;

a driving member that changes tension applied to the belt member by moving the first pressing member in a first direction and moving the second pressing member in a second direction; and a pressure member located to face the second pressing member with the belt member interposed between the pressure member and the second pressing member, the pressure member biased toward the second pressing member, wherein the driving member loosens the belt member by moving the first pressing member in the first direction and moving the second pressing member in the second direction, and the driving member biases the pressure member in a direction away from the second pressing member in a loosened state in which the belt member is loosened.

2. The belt unit according to claim 1, wherein the pressure member is in contact with the belt member to form a nip portion in a tightly-stretched state where the tension is applied to the belt member.

3. The belt unit according to claim 1, further comprising:

a supporting section that supports the driving member;

a first biasing member attached to the supporting section and configured to bias the first pressing member in the direction opposite to the first direction; and a second biasing member attached to the supporting section and configured to bias the second pressing member in the direction opposite to the second direction.

4. The belt unit according to claim 3, wherein the driving member is a cam rotatably supported by the supporting section.

5. The belt unit according to claim 1, further comprising at least one roller configured to hold the belt member so that the belt member is rotatable.

6. The belt unit according to claim 1, wherein the first pressing member includes a heater such that heat generated by the heater is transmitted to the belt member.

7. The belt unit according to claim 1, wherein the belt member is annular, and the first and second pressing members are located in a space surrounded by the belt member.

8. An image formation apparatus, comprising the belt unit according to claim 1.

9. The belt unit according to claim 1, further comprising:

a driving roller provided in contact with an inner circumferential surface of the belt member, and configured to drive and rotate the belt member; and a guide roller provided in contact with the inner circumferential surface of the belt member, and configured to be driven with rotation of the belt member.

10. The belt unit according to claim 1, wherein the first and second directions are substantially opposite to each other.

11. A belt unit, comprising:

a belt member;

a first pressing member in press contact with an inner circumferential surface of the belt member;

a second pressing member in press contact with an inner circumferential surface of the belt member;

a third pressing member in press contact with an inner circumferential surface of the belt member;

a pressure member provided outside of the belt member and opposed to the second and third pressing member with the belt member therebetween;

a driving mechanism that moves the first pressing member, the second pressing member, and the pressure member among a first mode, a second mode, and a third mode;

a controller that controls the driving mechanism to arrange the first pressing member, the second pressing member, and the pressure member in one of the first to third modes, wherein in the first mode, the pressure member is pressed against the second and third pressing members with the belt member therebetween so as to form a first nip between the pressure member and the second and third pressing members, in the second mode, the pressure member is moved in a direction away from the belt member with respect to the first mode, so as to form a second nip between the pressure member and the second and third pressing members, a length of the second nip being smaller than a length of the first nip, and in a third mode, each of the pressure member, the first pressing member, and the second pressing member is moved in a direction away from the belt member with respect to the first mode.

12. The belt unit according to claim 11, further comprising a first bias member that biases the first pressing member in a first direction;

a second bias member that biases the second pressing member in a second direction; and a third bias member that biases the pressure member in a third direction, wherein the controller controls, in the third mode, the driving mechanism such that the first pressing member and the second pressing member is moved against biasing forces of the first and second bias members, respectively, and such that the pressure member is moved against a biasing force of the third bias member.

13. The belt unit according to claim 11, wherein the first mode and the second mode form tightly-stretched states where the belt member is tightly-stretched, and the third mode forms a loosened state where the belt member is loosened.

14. The belt unit according to claim 11, wherein the first pressing member includes a heater such that heat generated by the heater is transmitted to the belt member.

15. The belt unit according to claim 14, wherein the first and second modes are modes wherein the belt unit fixes a developer image onto a medium by using the heat, and the third mode is a stand-by mode wherein the belt unit does not fix the developer image onto the medium by using the heat.

16. The belt unit according to claim 15, wherein the second mode is a mode wherein the belt unit fixes a developer image onto a special medium.

17. The belt unit according to claim 11, wherein the first and second pressing members are opposed to each other in a space defined by the inner circumferential surface of the belt member, and the direction in which the first pressing member is moved by the controller and the direction in which the second pressing member is moved by the controller are substantially parallel to each other and are opposite each other.

* * * * *